US011204157B2

(12) United States Patent
Maghnagi et al.

(10) Patent No.: US 11,204,157 B2
(45) Date of Patent: Dec. 21, 2021

(54) MOTORIZED SPOTLIGHT WITH AXIALLY OFFSET VERTICAL ARM

(71) Applicant: FORMA LIGHTING ITALIA S.R.L., Milan (IT)

(72) Inventors: Lawrence Maghnagi, Milan (IT); Angelino Tacchi, Milan (IT)

(73) Assignee: FORMA LIGHTING ITALIA S.R.L., Milan (IT)

( * ) Notice: Subject to any disclaimer, the term of this patent is extended or adjusted under 35 U.S.C. 154(b) by 0 days.

(21) Appl. No.: 16/978,928

(22) PCT Filed: Mar. 7, 2019

(86) PCT No.: PCT/IB2019/051839
§ 371 (c)(1),
(2) Date: Sep. 8, 2020

(87) PCT Pub. No.: WO2019/175718
PCT Pub. Date: Sep. 19, 2019

(65) Prior Publication Data

US 2020/0408391 A1 Dec. 31, 2020

(30) Foreign Application Priority Data

Mar. 12, 2018 (IT) ..... 102018000003442

(51) Int. Cl.
*F21V 21/15* (2006.01)
*F21S 8/02* (2006.01)
(Continued)

(52) U.S. Cl.
CPC ..... *F21V 21/15* (2013.01); *F21S 8/028* (2013.01); *F21V 21/26* (2013.01); *F21V 21/30* (2013.01)

(58) Field of Classification Search
CPC ... F21W 2131/406; F21V 21/14; F21V 21/15; F21V 21/26; F21V 21/30; F21S 8/028
See application file for complete search history.

(56) References Cited

U.S. PATENT DOCUMENTS

| | | | | |
|---|---|---|---|---|
| 10,295,161 | B1 * | 5/2019 | Shih | F21V 14/06 |
| 2012/0211448 | A1 * | 8/2012 | Markey | F16M 11/18 211/26 |
| 2014/0313727 | A1 * | 10/2014 | Dupre | F21V 21/30 362/287 |

* cited by examiner

*Primary Examiner* — Rajarshi Chakraborty
*Assistant Examiner* — Steven Y Horikoshi

(57) ABSTRACT

Spotlight with a vertical central axis (Z-Z), comprising: —a housing (210;110) extending between a bottom end for carrying a light source (L) and with a central axis passing through said ends; —a displaceable frame (130;230;330;430); —a support arm (120;220) for supporting the housing, which extends parallel to the vertical central axis (Z-Z) and a bottom end of which is rotationally connected to the top end of the housing (110;220), so as to allow rotation of the housing relative to the support arm (120;220) about a longitudinal axis of rotation (S-S) perpendicular to the vertical axis (Z-Z), between a non-rotated position, in which the housing is arranged with its central axis coinciding with the vertical central axis (Z-Z) of the spotlight, and a completely rotated position, in which the housing is arranged at an angle of at least 90° relative to the vertical central axis (Z-Z), wherein the longitudinal axis of rotation (S-S) of the housing is arranged in a position offset in the transverse direction relative to the vertical central axis (Z-Z) on the opposite side to the support arm (120;220); —means for rotationally actuating the housing about the longitudinal axis (S-S), arranged inside the housing; —means (160;260) for rotationally actuating the support arm (120;220) relative to the movable frame, about an axis parallel to the central vertical axis (Z-Z).

15 Claims, 6 Drawing Sheets

(51) Int. Cl.
*F21V 21/26* (2006.01)
*F21V 21/30* (2006.01)

Z 182
140
180
100
171
181
130
171a
172
S
173
120
111a
121
113
111
113a
110
S
112
110b
110a
L
L1
X
Y
Y
X
Z

MOTORIZED SPOTLIGHT WITH AXIALLY OFFSET VERTICAL ARM

TECHNICAL FIELD OF THE INVENTION

The present invention relates to a motorized spotlight.

PRIOR ART

There exist various types of recessed spotlights for mounting in ceilings, which are motorized and can be controlled by means of a remote control, said spotlights being movable in a vertical direction between an inset position and a position extracted from a recessed container.

Examples of such known spotlights are described for example in DE 20 2013 105693 U1 and US2011/002132 A1.

Furthermore there exist various types of spotlights which are able to be displaced along ceiling-mounted guides, these being also motorized and controllable by means of a remote control.

Such spotlights are particularly useful in commercial exhibition premises, museums or hospitals, where frequent variations of the surroundings and/or lighting conditions require adaptation of the direction of the light beam.

A technical problem which the invention aims to solve is that of providing a spotlight to be fixed to a ceiling and able to allow a wide degree of versatility as regards the orientation of the light beam.

In connection with this problem it is also desirable that this device should have small dimensions, be easy and inexpensive to produce and assemble and be able to be easily installed at any user location using normal standardized connection means.

These results are obtained according to the present invention by a spotlight according to the characteristic features of claim 1.

Figure 1:
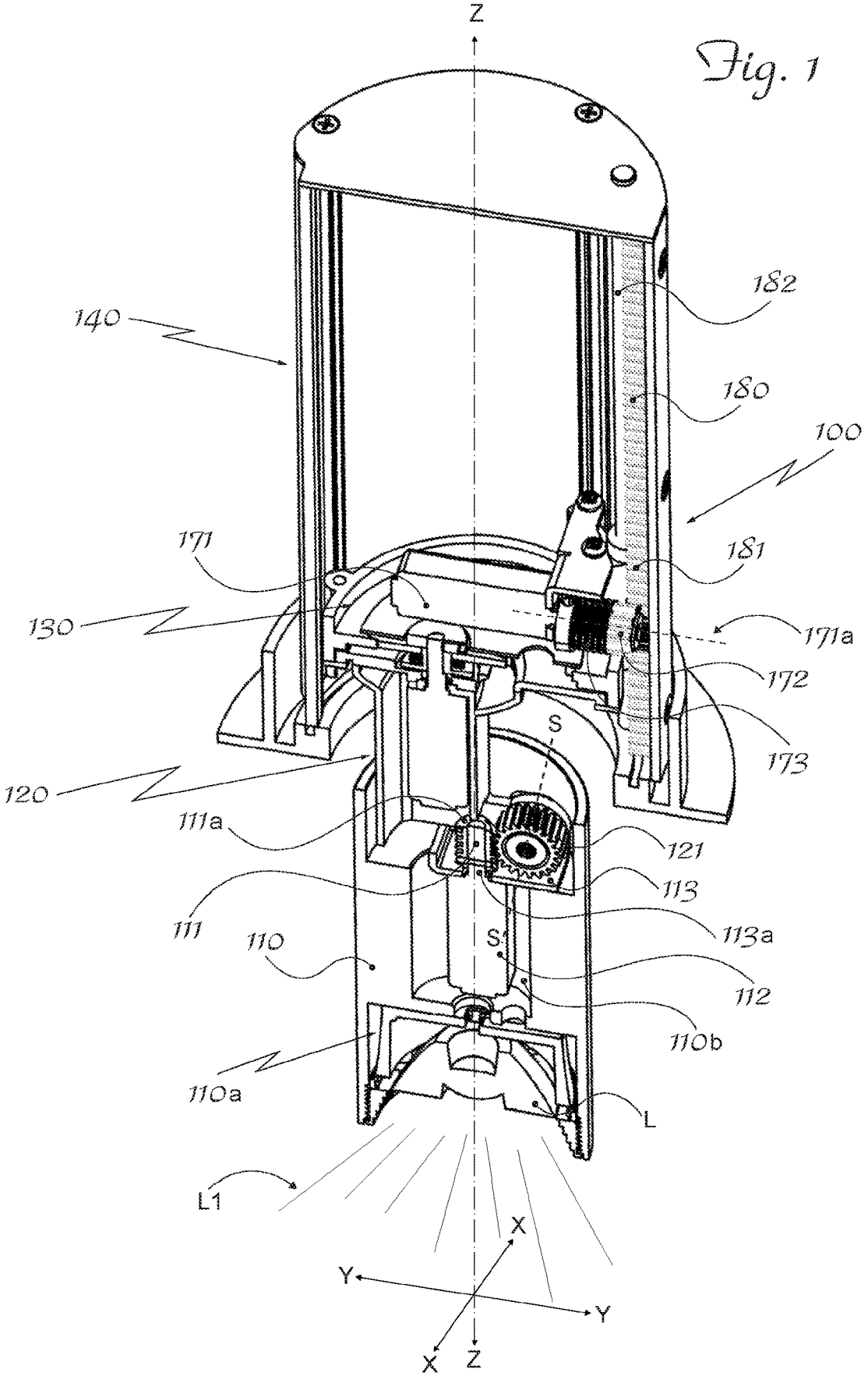
Figure 2A:
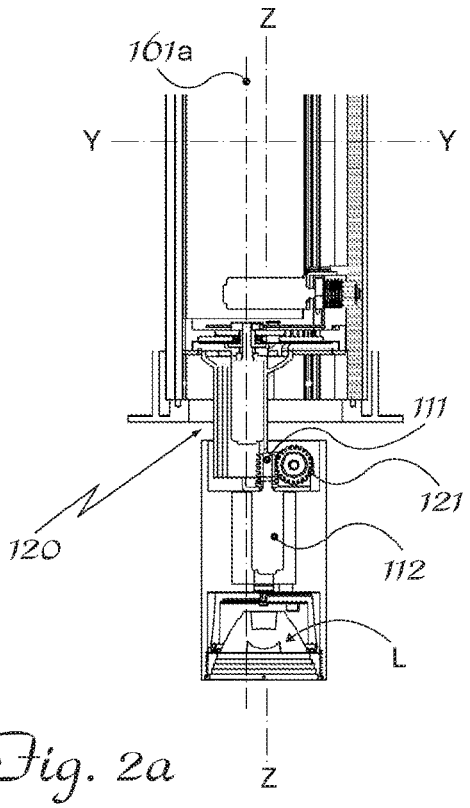
Figure 2B:
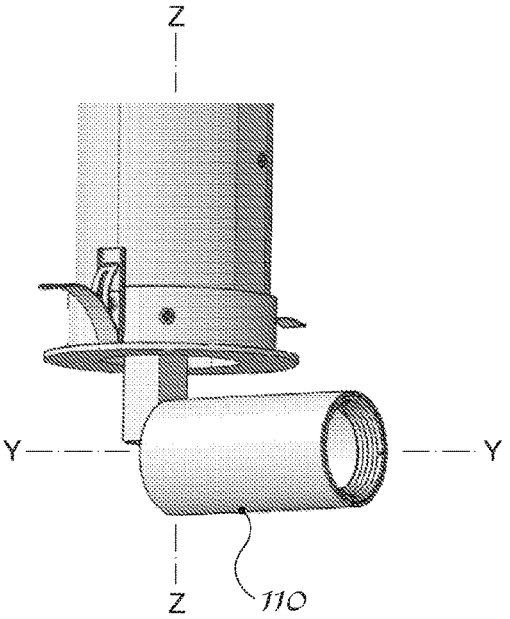
Figure 5:
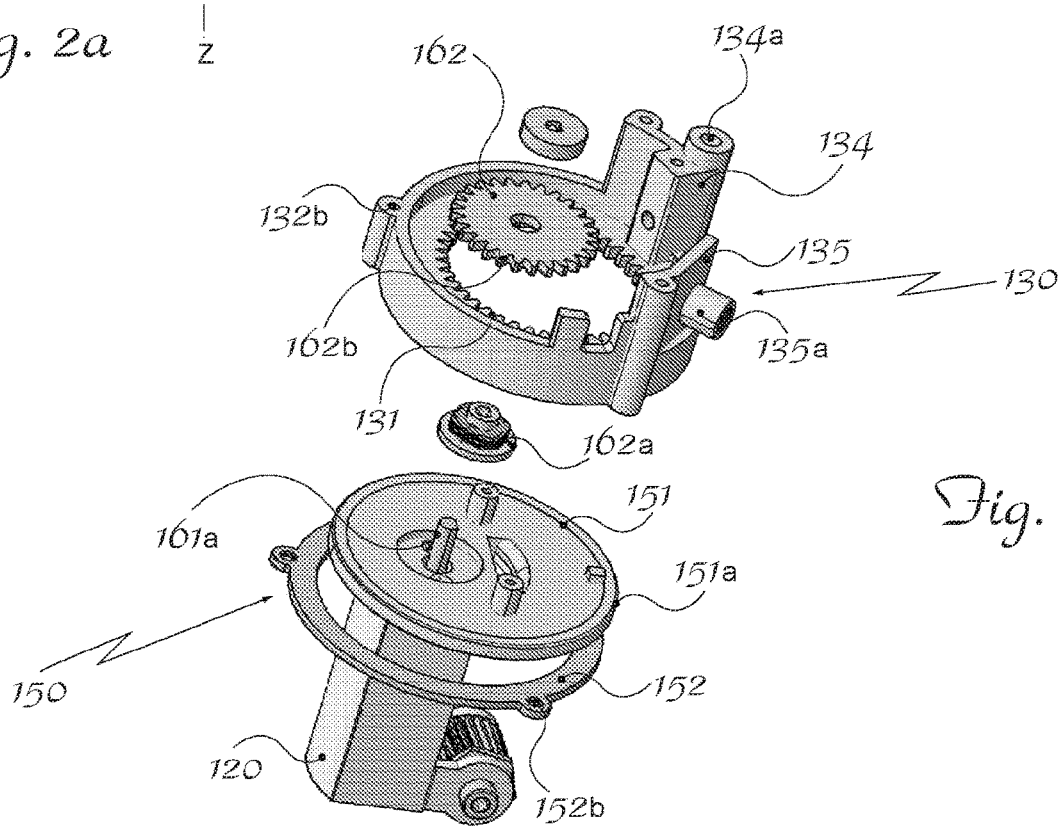
Figure 3:
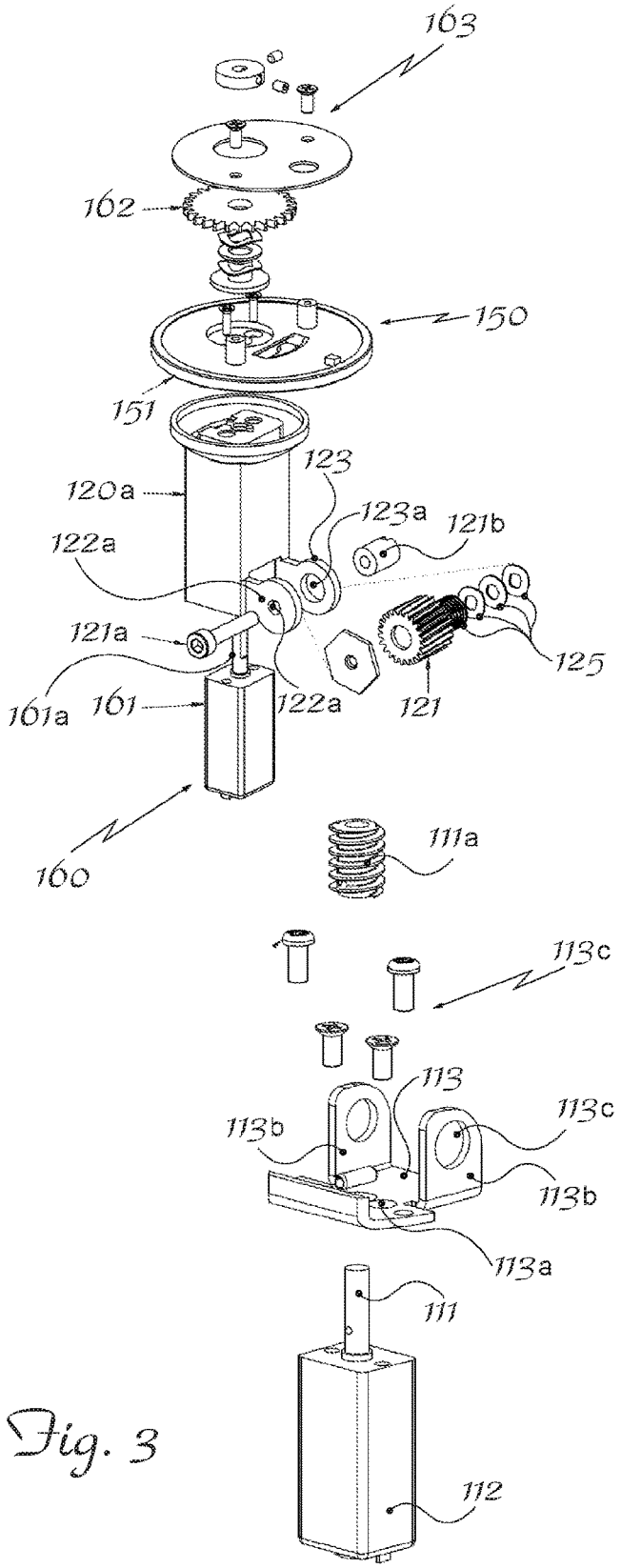
Figure 4A:
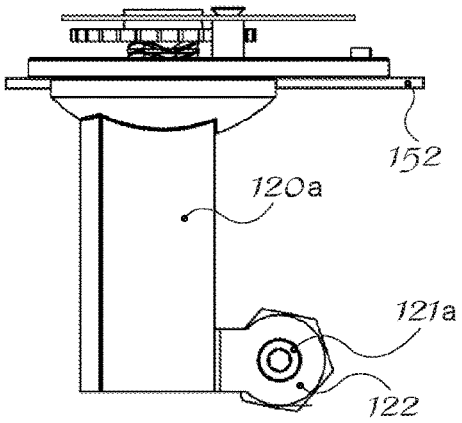
Figure 4B:
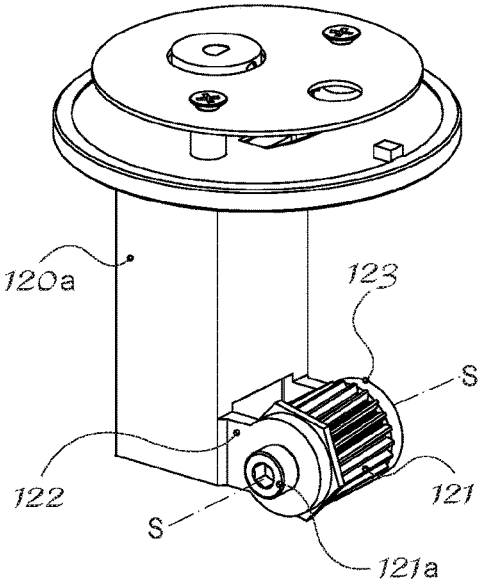
Figure 6:
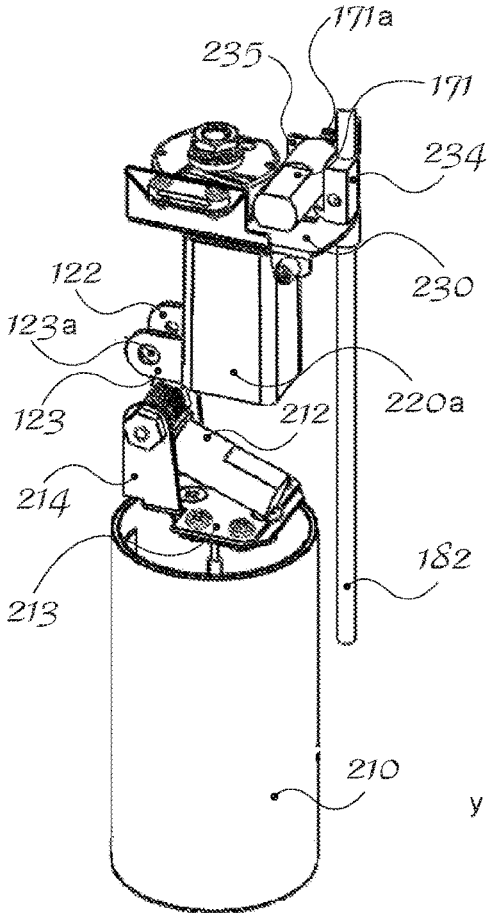
Figure 7:
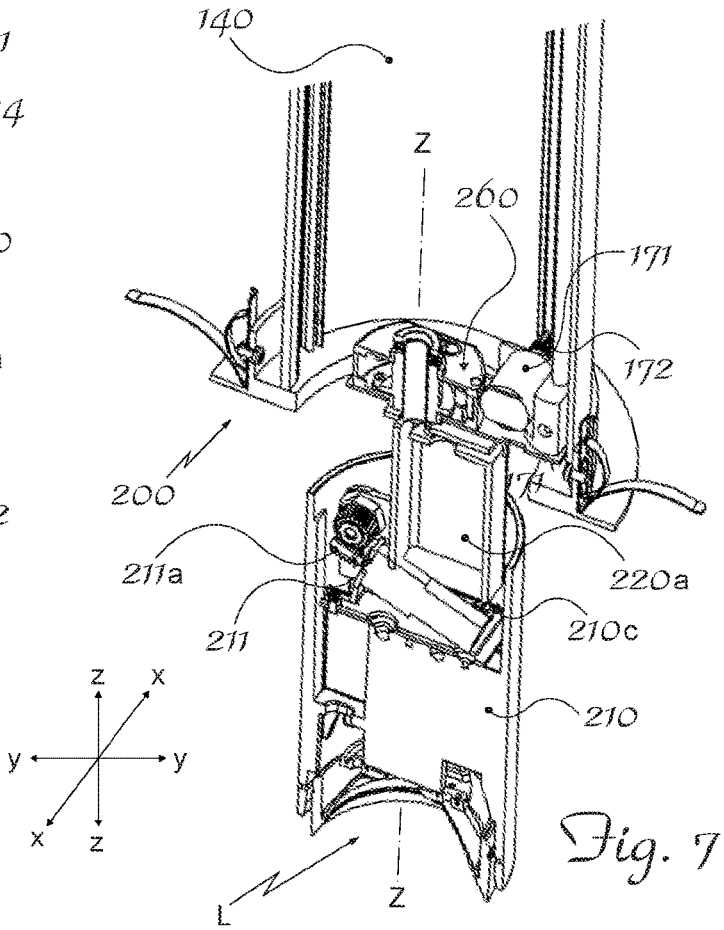
Figure 8:
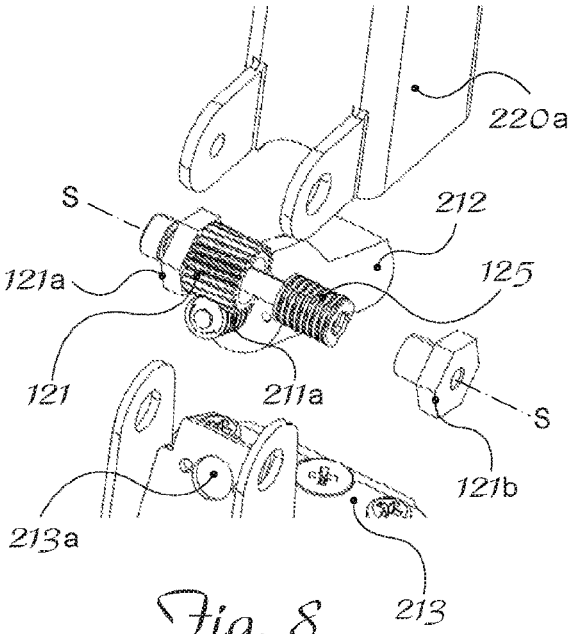
Figure 9:
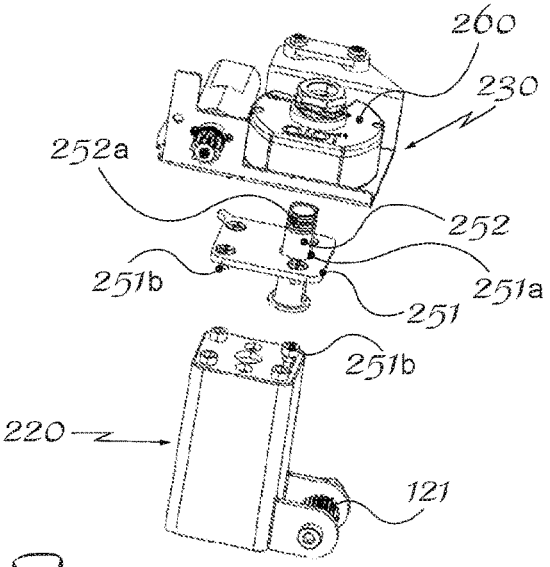
Figure 10:
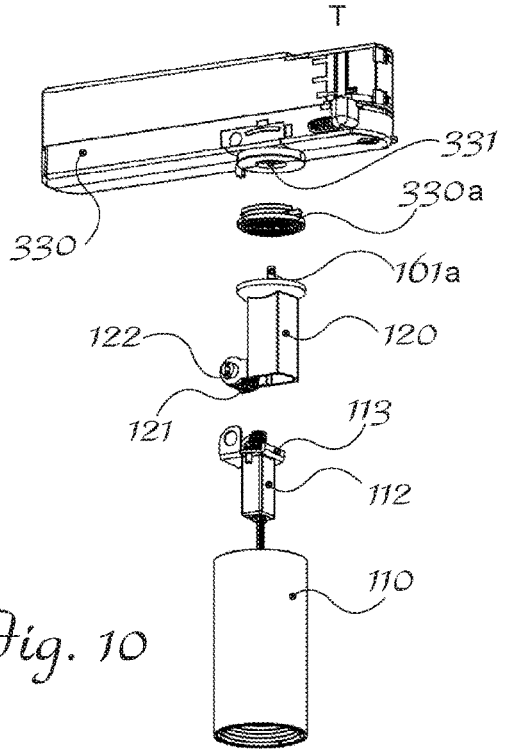
Figure 11:
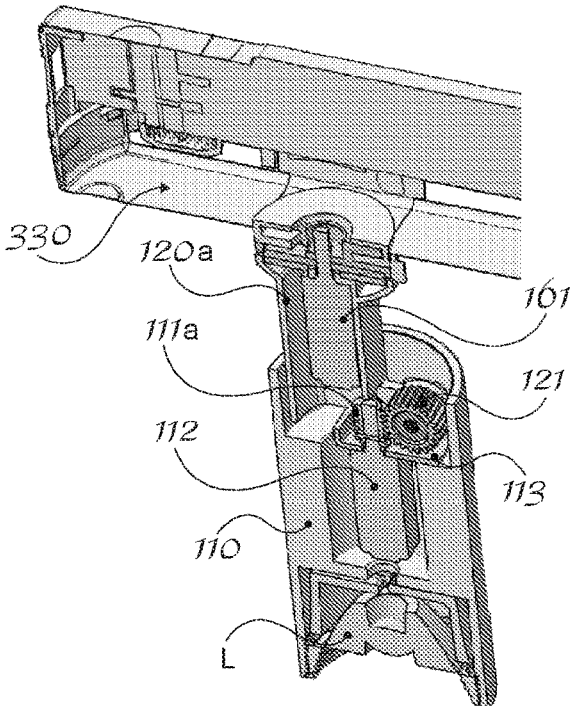
Figure 12:
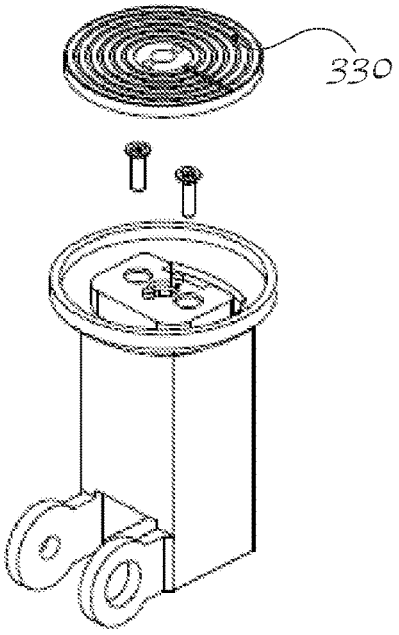
Figure 13:
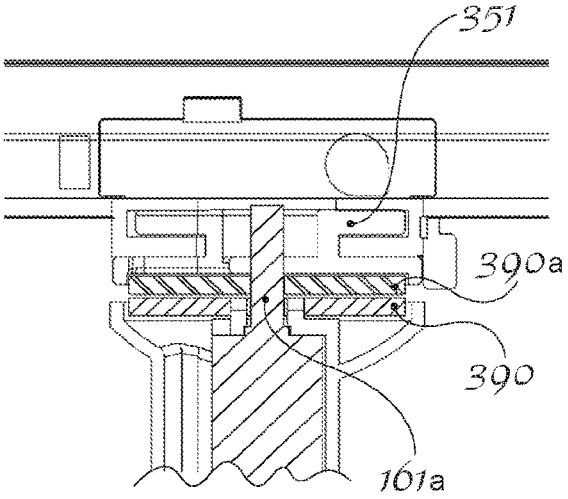
Figure 14A:
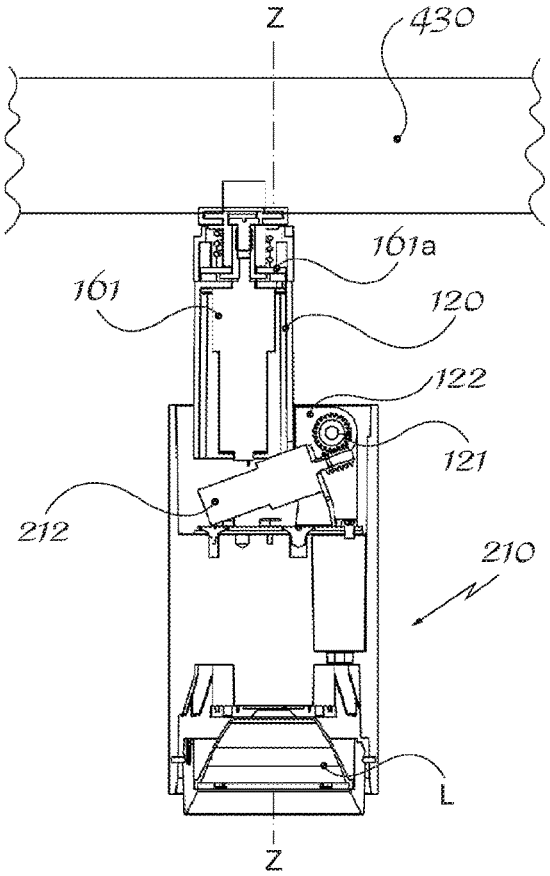
Figure 14B:
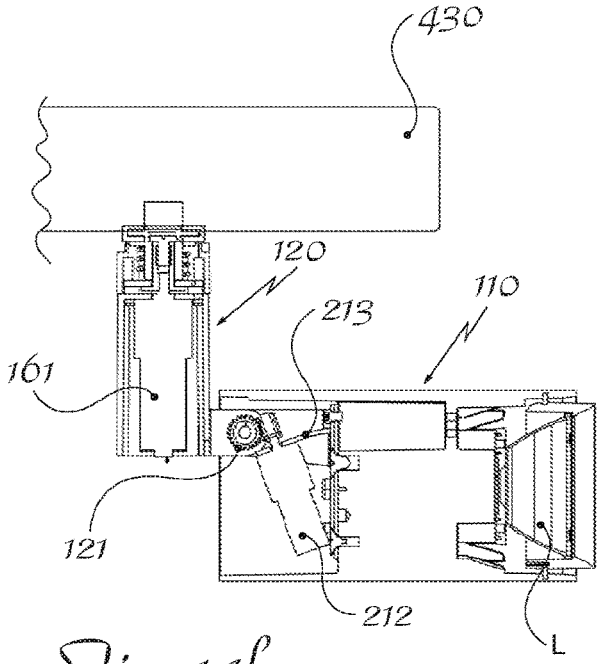
Figure 15:
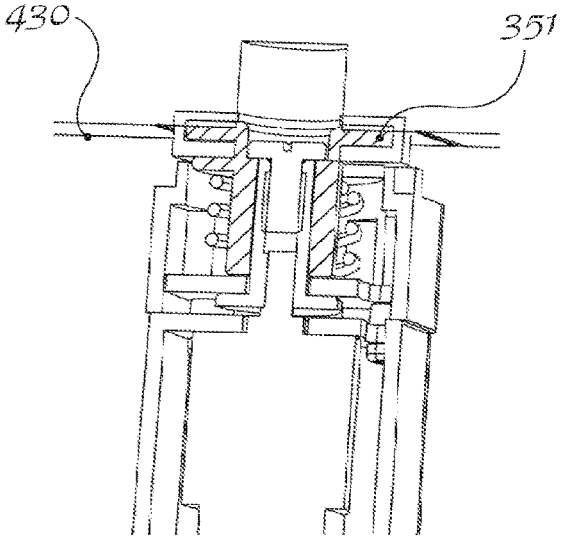
Figure 16:
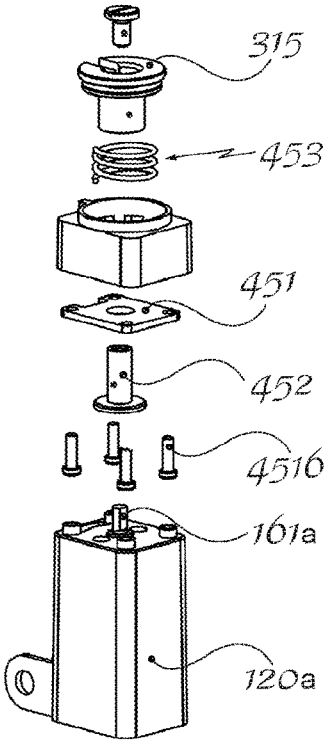

Further details may be obtained from the following description of non-limiting examples of embodiment of the subject of the present invention, provided with reference to the accompanying drawings, in which:

FIG. 1: shows a vertically sectioned perspective view of a first embodiment of a ceiling spotlight according to the invention;

FIG. 2A: shows a vertically sectioned side view of the spotlight according to FIG. 1, in a configuration with the lamp not rotated;

FIG. 2B: shows a perspective view of the spotlight according to FIG. 1 in a configuration with the lamp rotated through 90° about a horizontal axis;

FIG. 3: shows an exploded perspective view of the support arm and the means for rotational actuation of the housing of the spotlight according to FIG. 1;

FIG. 4A: shows a side view of the arm according to FIG. 4 in the assembled condition;

FIG. 4B: shows a perspective view of the arm according to FIG. 4 in the assembled condition;

FIG. 5: shows a partially exploded perspective view of a detail of the spotlight according to FIG. 1 without its external structure;

FIG. 6: shows a perspective view of a second embodiment of the spotlight according to the present invention, in the partially assembled condition;

FIG. 7: shows a vertically sectioned view of the spotlight according to FIG. 6 in the assembled condition;

FIG. 8: shows a perspective view of a detail of the spotlight according to FIG. 6;

FIG. 9: shows a perspective view of a detail of the connection between the support arm and the movable frame of the spotlight according to FIG. 6 in the exploded condition;

FIG. 10: shows a partially exploded view of a third embodiment of a spotlight according to the invention;

FIG. 11: shows a vertical sectioned view of the spotlight according to FIG. 10;

FIG. 12: shows a perspective view of a detail of the support arm of the spotlight according to FIG. 10;

FIG. 13: shows a vertically sectioned view of a detail of the connection between the support arm and the movable frame of the spotlight according to 10;

FIG. 14A: shows a vertically sectioned view of a fourth embodiment of a spotlight according to the invention;

FIG. 14B: shows a vertical sectioned view of the spotlight according to FIG. 14A rotated through 90°;

FIG. 15: shows a vertically sectioned view of a detail of the connection between the support arm and the movable frame of the spotlight according to FIG. 14; and FIG. 16: shows a partially exploded perspective view of the support arm of the spotlight according to FIG. 14.

For greater clarity, the details which are conventional per se, such as electrical wiring and ceiling fixing elements, have been excluded from all the figures.

With reference to FIG. 1, a first embodiment of a spotlight 100 according to the invention comprises a light source L inserted in the free end of a housing 110, the opposite end of which is connected to a support arm 120 in turn mounted on a movable frame 130 housed inside a cylindrical container 140 which can be fixed to a ceiling. With the reference to the non-rotated configuration shown in FIG. 1, three reference axes are assumed for easier description and without a limiting meaning, namely: in the vertical direction Z-Z corresponding to the central axis of longitudinal extension of the housing 110 and to the axis of propagation of the light beam L1 emitted by the light source L, in the non-rotated configuration (and in the case of FIG. 1 at the height of the cylindrical housing 140); in the longitudinal direction X-X, perpendicular to the preceding direction and parallel to an axis of rotation of the housing 110 with respect to the support arm 120; and in the transverse widthwise direction Y-Y of the spotlight, perpendicular to the two preceding directions and, with the support arm 120 in the position according to FIGS. 1,2, corresponding to the central axis of the housing 110 and the beam emitted by the light L in the configuration where the housing is rotated through 90° with respect to the support arm 120 (FIG. 2*b*). Furthermore, a bottom part, corresponding to the end which has the housing 110 and the light source L, and a top part opposite to the bottom part in the vertical direction Z-Z, are assumed.

As shown, the first embodiment of a motorized spotlight 100 according to the invention comprises a vertical support arm 120, which extends in a position axially offset transversely with respect to the vertical central axis Z-Z and the bottom end of which carries a gear wheel 121 with a longitudinal axis S-S perpendicular to the axis Z-Z.

As shown, the longitudinal axis S-S is a position offset transversely with respect to the vertical central axis on the opposite side to the support arm 120.

The wheel 121 is able to mesh with a pinion 111*a* actuated by the shaft 111 of a motor 1121 integral with the cylindrical housing 110, so that actuation of the shaft of the motor 111*a* causes rotation of the housing 110 with respect to the vertical arm 120 about the said longitudinal axis of rotation S-S.

As shown in FIGS. 2A,2B, the cylindrical housing 110 is designed to rotate about the longitudinal axis S-S upon actuation of the motor 112 between the vertical/non-rotated position, where the axis of the housing is arranged parallel to and coincides with the vertical axis Z-Z (FIG. 2A), and a position which is completely rotated, preferably through 90° (FIG. 2B), in the opposite direction to the support arm 120.

Owing to the axially offset arrangement of the support arm 120 it is possible to keep the vertical and transverse extension of the spotlight compact, this being particularly advantageous for recessed spotlights, allowing also the dimensions of the container 140 to be reduced.

With reference to FIG. 1, the housing 110 has preferably a substantially cylindrical form and comprises a first bottom compartment 110*a*, which houses the light source L so that the light beam emitted by it may propagate towards the outside of the housing; and a second, generally middle, compartment 110*b* which houses the motor for rotationally actuating the housing 110.

A third top compartment 110*c* is open towards the support arm 120 and contains a plate 113 (FIG. 3) hinged at the axis of rotation S-S by means of a pair of parallel vertical flanges 113*b*, each with a through-hole 114*a* perpendicular to the vertical direction and arranged so that the through-holes 114*a* are coaxial with through-holes 122*a*, 123*a* of flanged projecting from the arm 120 and described further below. The plate 113 is also provided with a vertical-axis through-hole 113*a* able to allow insertion of the shaft 111 of the motor 112, which is thus axially constrained to the plate 113 once assembled with the pinion 111*a*.

The plate 113 is fixed to the housing 110 for example by means of screws 113*c*.

With reference to FIGS. 3 and 4, a preferred example of the support arm 120 comprises a vertical body 120*a* which has at its bottom end in the vertical direction two flanges 122, 123 projecting in the transverse direction Y-Y and arranged parallel and spaced in the longitudinal direction X-X; each flange is provided with a respective through-hole 122*a*, 123*a* designed to allow insertion of a pin 121*a* which couples the gear wheel 121 to the flanges 122,123, and therefore to the support arm 120, so that the gear wheel 121 is stably joined to the flanges 122,123 and therefore the arm 120.

The pin (or screw) 121*a* may by fixed by means of female-thread means such as a bolt or nut 121*b*. Advantageously, a sliding friction means 125 may be coaxially inserted inside the gear wheel 121 in order to prevent manual movements of the housing 120 from damaging the motor 112 for rotationally actuating the housing 120. Preferably, the friction means 125 may comprise a spring or a plurality of spring washers coaxially mounted on the pin 121*a*; such a sliding friction means 125 is adjustable by means of the female-thread element 121*b* for fixing the pin 121*a*, which allows the springs or washer 125 to be tightened so as to press the gear wheel against the flange 1221, so that it is rigidly fixed to the arm 120.

Once the spotlight has been assembled, the pin 121*a* which defines the axis of rotation S-S of the housing with respect to the support arm 120 passes through both the flanges 122,123 of the arm and the flanges of the plate 113 of the housing 110, therefore rotationally coupling together the support arm 120 and the housing 110.

The spotlight further comprises (FIGS. 3 and 5) means 150 for connecting together the support arm 120 and the movable frame 130.

In the first embodiment said connecting means comprise: a plate 151 directed in a transverse-longitudinal plane X-Y, fixed to the top end of the arm 120 and with a diameter such as to define the outer annular edge 151*a* projecting towards the outside of the said arm; a ring 152 on the outside of the body 120*a* of the arm 120 and with an internal diameter such as to engage in the vertical direction with the annular edge 151*a* in the vertical direction, and means for fixing the ring 152 to the frame 130, for example comprising vertical-axis holes 152*b* in the ring 151, corresponding holes or sleeves 132*b* in the movable frame 130 and fixing screws or pins for fixing together the movable frame 130 and the ring 152 in the vertical direction Z-Z.

With reference still to FIGS. 3 and 5, the spotlight 100 further comprises means 160 for rotationally actuating the support arm 120 about a vertical axis relative to the movable frame 130.

In the embodiment shown, the actuating means comprise a vertical-axis motor 161 which is inserted inside and fixed to the body 120*a* of the support arm 120 so that its shaft 161*a* projects in the vertical direction beyond the top end of the body 120 and the plate 151 (FIG. 5). A gear 162 is mounted on the shaft 161*a*, preferably by means of a coaxial support which has sliding friction means 162*a*. The gear 162 is designed to rotate with the shaft 161*a* of the motor and has an outer toothing 162*a* designed to mesh, once coupled together, with an inner annular toothing 131 of the frame 130. The gear 162 (FIGS. 3, 4) has an outer diameter smaller than the inner diameter of the annular toothing 131 and may be fixed to the shaft of the motor 161 and to the support arm 120 via fixing means 163, not described in detail.

When the motor 161 is operated, the rotation of the shaft 161*a* will cause rotation of the gear 162 which, meshing with the toothing 131 on the frame 130, will rotationally actuate the arm 120 with respect to the frame 130 about the central vertical axis Z-Z; the different diameters of the gear 162 and the inner toothing 131 allow the housing 110 to be kept always centred with respect to the vertical central axis.

The axially offset position of the arm 120 and the rotational actuating means thus allow the lamp L to be oriented through 360° about the vertical axis Z-Z in a simple and precise manner, within a confined space. Advantageously, in this embodiment (FIG. 3), although the axis of rotation 161*a* of the motor is also axially offset transversely with respect the vertical central axis Z-Z, the arm and the housing rotate about the vertical central axis, thus allowing the support arm 120, which is axially offset, to rotate freely inside the container 140 within a space essentially only slightly bigger than the outer diameter of the housing 110.

In the first embodiment, the movable frame is in the form of an annular ferrule 130 comprising said toothing 131 on its inner annular edge.

The movable frame 130 also comprises in a radially outer position:

an upright 134 with a vertical-axis through-hole 134*a* and/or a vertical flange 135 with a transverse-axis hollow sleeve 135*a*.

It is also envisaged providing means 170 for displaceably actuating the movable frame 130 in both directions along the vertical axis Z-Z so as to cause insertion/extraction of the housing 110 and the support arm 120 (displaceably integral with the frame 130) into/from the container 140, coaxially with the central vertical axis Z-Z of the said container 140 (and the housing 110).

In the example, the means 170 for vertical movement of the frame 130 comprise a motor 171 arranged on the frame 130 and displaceably integral therewith, the shaft 171*a* thereof extending parallel to the transverse direction Y-Y and being inserted in the sleeve 135*a* so as to project transversely outside the frame 130. A pinion 172 is fixed to the shaft 171*a*, preferably via friction means 173.

The pinion 172 meshes with the teeth 181 of a rack 180 extending parallel to the vertical direction Z-Z and fixed to the inner surface of the container 140. Owing to the configuration of the vertical displacement means, the transverse/radial dimensions of the spotlight may be kept small, since merely the pinion 172 need project transversely from the movable frame 130.

Preferably a guide bar 182 is fixed to the container 140 and inserted inside the vertical hole 134*a* of the upright 134 so as to form an element for guiding the vertical displacement of the frame 130.

With this configuration, rotational actuation of the pinion 172 causes the displacement in the vertical direction of the frame 130 guided by the bar 182, allowing the support arm 120/housing 110 assembly to be moved from the non-rotated and completely extracted position shown in FIG. 1 into a configuration completely retracted in the vertical direction Z-Z where the housing and arm are enclosed inside the cylindrical container 140.

With reference to FIGS. 6-9, a second embodiment 200 of the spotlight according to the invention has a respective housing 210 for a light source L, mounted on a support arm 220 axially offset transversely with respect to the vertical central axis Z-Z of the housing, when the latter is in the non-rotated configuration (FIGS. 6-7). The support arm 220 is in turn connected to a frame 230 movable in the vertical direction Z-Z so as to be displaceably integral therewith. In FIGS. 6-9 corresponding parts are indicated by the same reference numbers and/or letters used for the embodiment described above.

As shown, the bottom end of the arm 220 carries a gear wheel 121 with a longitudinal axis S-S perpendicular to the axis Z-Z and designed to mesh with a pinion 211*a* actuated by the shaft 211 of a motor 112 fixed to the cylindrical housing 210 so as to cause rotation of the housing 210 with respect to the vertical arm 220 about the said longitudinal axis S-S of rotation. In a similar manner to that described above, the gear wheel 121 may be mounted on projecting flanges 122, 123.

An upper compartment 210*c* in the cylinder 210 is open towards the support arm 220 and contains a plate 213 fixed to the housing 210 and provided with a tongue 213*b* projecting upwards with a through-hole 213*a* (FIG. 8) designed to allow insertion of the shaft 211 of the motor 212 which in this way is axially constrained to the plate 213 once assembled with the pinion 211*a*.

As shown, the motor 212 is preferably arranged inclined with respect to the vertical axis and the transverse-longitudinal plane Y-X so that its axis forms an angle with both of them, this allowing the space occupied by the housing both in the transverse direction and in the vertical direction to be limited, while favouring the compactness of the spotlight.

The plate 213 comprises a transverse-longitudinal surface fixed to the housing 110, a pair of parallel vertical flanges 214, each with a through-hole 214, which are arranged so that the through-holes 214*a* are arranged coaxial with the through-holes 122*a*,123*a* of the flanges 122,123 such that, when the spotlight is assembled, the pin 121*a* which forms the axis of rotation S-S of the housing 210 with respect to the support arm 120 passes through both the flanges 122,123 of the arm and the flanges 214 of the housing 210, so that the arm and housing are hinged together. The pin (or screw) 121*a* may be fixed to the flanges by female-thread means such as a bolt or nut 121*b* and a sliding friction means 125 may be coaxially inserted inside the gear wheel 121, in a similar manner to that described above.

The means 250 for connecting together the support arm 220 and the movable frame 230 comprise a plate 251 directed in a transverse-longitudinal plane X-Y, fixed to the top end of the arm 220 by means of complementary fixing means 251*b* and comprising a vertical-axis hole 251*a* in a position corresponding to the central vertical axis Z-Z. A vertical-axis sleeve 252 also corresponding to the central axis Z-Z is inserted inside the hole 251*a*. The top end of the sleeve has an outer thread 252*a* and the bottom end has an annular edge projecting radially with an outer diameter greater than the diameter of the hole 251*a*, and the sleeve is formed and inserted inside the hole so that, once the plate 251 is fixed to the arm 220, the sleeve 252 is both displaceably and rotationally integral with the arm 220.

The sleeve 252 is designed to be connected, for example by means of the thread 252*a* and preferably via sliding friction means, to the output member of a vertical-axis gearmotor 260 which allows rotational actuation of the support arm 220 about the vertical central axis Z-Z relative to the movable frame 130.

When the gearmotor 261 is operated, the sleeve 252 is rotationally actuated so as to cause the rotation of the arm 220 relative to the frame 130 about the vertical central axis Z-Z, while maintaining all the advantages described above. If the friction means is present between the motor and the female-thread element for fixing the sleeve 252, it allows the pin 252 to make frictional contact against the plate 251.

In this embodiment, the movable frame 230 is in the form of a plate to which the gearmotor 260 is fixed. Preferably, the plate 230 comprises moreover on its outer edge an upright 234 with a vertical-axis through-hole and/or a vertical flange 235 with a hole or hollow sleeve having an axis perpendicular to the vertical direction.

The means 170 for displaceably actuating the movable frame 230 in both directions along the vertical axis Z-Z in order to cause insertion/extraction of the housing 210 and the support arm 220 into/from the container 240, coaxially with the central vertical axis Y-Y of the said container 240, are substantially similar to the means described in the preceding embodiment. These means 170 comprise for example a motor 171 arranged on the frame 230 and displaceably integral therewith, the shaft thereof extending perpendicularly with respect to the vertical direction Z-Z and being inserted inside the sleeve of the flange 235 so as to project outside the frame 230. A pinion is preferably fixed to the shaft 171*a* with friction means arranged in between. The pinion 172 meshes with the teeth of a rack extending parallel to the vertical direction Z-Z and fixed to the inner surface of the container 140. Preferably, a guide bar 182 is inserted inside the vertical hole 234*a* of the upright 234 so as to form an element for guiding the vertical displacement of the frame 130.

With this configuration, the operation of the spotlight is similar to that described for the first embodiment.

According to a variation of embodiment, not shown, it is also possible to connect the housing which contains an inclined motor for rotational actuation about the longitudinal axis according to the second embodiment to the support arm of the spotlight shown in FIGS. 1-5, wherein the motor for rotationally actuating the support arm is housed inside the said arm.

With reference to FIGS. 10-13, a third preferred embodiment of the spotlight according to the invention comprises a housing 110 which supports a light source L, a plate 113 and a motor 112 for actuation about the longitudinal axis S-S and is connected to a support arm 120 in a similar manner to that described in connection with the first embodiment shown in FIGS. 1-5.

This embodiment differs from the first embodiment in that the support arm 120 is connected to a movable frame 330 which is in the form of a tracked adapter designed to be displaced in a direction perpendicular to the vertical direction X-X inside a path or track fixed to the ceiling (not shown). Preferably, the movable frame 330 comprises a driver for powering and controlled actuation of the spotlight, for connection to an electrified track. An example of such an adapter with driver and associated track is described in the publication WO97/34352.

According to the preferred embodiment shown, the connection of the support arm 120 to the movable frame 330 is performed by inserting the shaft 161*a* of the motor for actuating the arm 120 about an axis parallel to the vertical direction Z-Z inside a corresponding vertical-axis seat 331 in the bottom surface of the frame 330 and fixing the shaft 161*a* to the said frame, for example by means of a fixing bracket 351 which is interlocked with the frame 330 and which has the seat 331 inside which the shaft 161*a* of the motor is keyed (FIG. 13).

Preferably, a printed circuit 390 in the form of a flat element with central holes for coaxial mounting onto the shaft 161*a* of the motor 161 for actuating the arm 120 about the vertical axis is inserted between the arm 120 and the movable frame 330. The printed circuit 390 is in contact with a corresponding circuit 390*a* fixed to the bracket 351 (FIGS. 11 and 13) which is locked to the frame 330 and which forms the seat 331 inside which the shaft 161*a* of the motor 161 is keyed.

Power supply/connecting wires are soldered to the printed circuits 390,390*a* and the printed circuits act as brushes. Advantageously this solution avoids the use of connecting wires which would risk becoming tangled when the support arm rotates through 360° or more about the vertical axis Z-Z.

Preferably, in this embodiment also, sliding friction means are inserted between the shaft 161*a* of the motor and the bracket 351.

With reference to FIGS. 15 and 16, a fourth preferred embodiment of the spotlight according to the invention has a housing 210 with an inclined motor 212 for rotational actuation about the longitudinal axis S-S similar to that described for the second embodiment, said housing being connected to a support arm 120 inside which a motor 161 with a vertical-axis 161*a* is inserted in a similar manner to that described above in connection with the first and third embodiments of the spotlight (FIGS. 1-5 and 10-13).

The support arm 120 is connected to a movable frame 430 which is in the form of a tracked adaptor designed to be displaced in a direction perpendicular to the vertical direction X-X inside a path or track fixed to the ceiling (not shown). Preferably, the movable frame 430 comprises a driver for powering and controlled actuation of the spotlight, for connection to an electrified track. An example of such an adapter with driver is described in the publication WO97/34352.

According to the preferred embodiment shown and with reference to FIGS. 15 and 16, the connection of the support arm 120 to the movable frame 430 is performed in a similar manner to that described above, for example by means of a fixing bracket 351 which is interlocked with the frame 430 and which has a seat 331 inside which a sleeve 452 rotationally integral with the shaft 161*a* of the motor and fixed to the arm 120 for example by means of a flat element 451 and complementary fixing means 451*a* is fixed. Preferably, in this embodiment also, sliding friction means 453 are inserted between the sleeve 451 and the bracket 351.

As shown, in all the embodiments, the housing is configured so that, once connection to the support arm has been performed, the means for rotational actuation about the longitudinal axis S-S and for connection to the arm are hidden from view by the circumferential wall of the said housing.

It is therefore clear how the spotlight according to the invention allows an orientation of the light beam in different directions inclined by different degrees with respect to the vertical as far as a horizontal orientation substantially at 90° with respect to the vertical axis Z-Z of the spotlight, while ensuring that the spotlight remains compact both in the transverse/longitudinal direction and in the vertical direction. Moreover the beam allows rotation through 360° of the light beam about an axis parallel to the central vertical axis Z-Z even in a small space such as that of a ceiling-mounted recessed container.

In addition the particular form of the movement systems is such that they may be housed inside the spotlight, while remaining invisible from the outside and improving the aesthetic appearance of the assembly.

The friction drives ensure a high degree of safety for the spotlight which is not prone to breakages due to inappropriate handling movements.

It is also envisaged that the drives may be remotely controlled by means of radio reception and remote control devices, this making the assembly particular easy and convenient to manoeuvre so that the light beam may be adjusted into the various angled positions as required.

Although described in connection with a number of embodiments and a number of preferred examples of implementation of the invention, it is understood that the scope of protection of the present patent is determined solely by the claims below. In particular it is understood that the motors may be gearmotors or vice versa.

The invention claimed is:

1. Spotlight (100) with a vertical central axis (Z-Z), comprising:

a housing (210;110) extending between a bottom end for carrying a light source (L) and an opposite top end, and having a central axis passing through said ends;

a displaceable frame (130;230;330;430);

a support arm (120;220) for supporting the housing, which extends parallel to the vertical central axis (Z-Z) and a top end of which is connected to the movable frame (130;230;330;430) and a bottom end of which is rotationally connected to the top end of the housing (110;220), so as to allow rotation of the housing relative to the support arm (120;220) about a longitudinal axis of rotation (S-S) perpendicular to the vertical axis (Z-Z), between a non-rotated position, in which the housing is arranged with its central axis coinciding with the vertical central axis (Z-Z) of the spotlight, and a completely rotated position, in which the housing is arranged at an angle of at least 90° relative to the vertical central axis (Z-Z);

wherein the support arm (120;220) has a vertical body (120*a*) which extends in a position axially offset, in a transverse direction perpendicular to the vertical central axis (Z-Z) and longitudinal axis of rotation (S-S), relative to the vertical central axis (Z-Z), and the bottom end of the support arm carries a gear wheel (121), the axis of which coincides with the longitudinal axis of rotation (S-S) of the housing;

wherein the longitudinal axis of rotation (S-S) of the housing is arranged in an offset position in the transverse direction relative to the vertical central axis (Z-Z) on the opposite side to the support arm (120;220);

means for rotationally actuating the housing about the longitudinal axis (S-S), arranged inside the housing and comprising a shaft (111;211) rotating with a pinion (111*a*;211*a*) which meshes with the gear wheel (121);

means (160;260) for rotationally actuating the support arm (120;220) relative to the movable frame, about an axis parallel to the central vertical axis (Z-Z).

2. Spotlight according to claim 1, characterized in that the bottom end of the vertical body (120*a*) of the support arm has two flanges (122, 123) projecting in the transverse direction (Y-Y) and arranged parallel and spaced in the longitudinal direction (X-X), each flange being provided with a respective through-hole (122*a*,123*a*) designed to allow insertion of a pin (121*a*) which couples the gear wheel (121) to the flanges (122,121) and which forms the longitudinal axis of rotation (S-S) of the housing (110) relative to the support arm (120).

3. Spotlight according to claim 2, characterized in that it comprises a preferably cylindrical container for recessed mounting in a ceiling, with a longitudinal axis coinciding with the vertical central axis (Z-Z) of the spotlight, the movable frame, the support arm and the housing being arranged inside the container in a recessed configuration of the spotlight.

4. Spotlight according to claim 1, wherein the means for rotationally actuating the housing comprise a motor (112) which is integral with the housing (110) and which drives the shaft with pinion (111*a*) meshing with the gear wheel, the shaft of the motor being oriented parallel to the vertical axis or at an angle relative thereto.

5. Spotlight according to claim 1, characterized in that a plate (113) hinged to the longitudinal axis of rotation (S-S) by means of a pair of parallel flanges (113*b*) is fixed inside the housing, the plate (113) being provided with a through-hole (113*a*) inside which the shaft (111) of the motor (112) is inserted so as to be axially constrained to the plate (113).

6. Spotlight according to claim 1, characterized in that the means (160;260) rotationally actuating the support arm comprise a vertical-axis motor (161) inserted inside and fixed to the body (120*a*) of the support arm (120).

7. Spotlight according to claim 6, characterized in that the vertical shaft (161*a*) of the means for rotationally actuating the support arm has, mounted thereon, a gear (162) arranged to rotate with the said shaft and having an outer toothing (162*b*) which meshes with an inner annular toothing (131) of the movable frame (130), wherein the outer toothing of the gear has an outer diameter smaller than the diameter of the inner annular toothing (131) of the movable frame.

8. Spotlight according to claim 1, characterized in that the means for rotationally actuating the support arm relative to the frame are configured to cause the rotation of the support arm about the central vertical axis (Z-Z) of the spotlight.

9. Spotlight according to claim 1, characterized in that the means for rotationally actuating the support arm relative to the frame comprise a gearmotor (260) with a vertical axis which is mounted on the movable frame and the output member of which is joined together with a sleeve (252) having a vertical axis corresponding to the central axis (Z-Z) and being both displaceably and rotationally integral with the top end of the support arm (220).

10. Spotlight according to claim 1, characterized in that the movable frame (330) is in the form of a tracked adapter designed to be displaced in a direction (X-X) perpendicular to the vertical direction inside a fixed track.

11. Spotlight according to claim 1, characterized in that the tracked adapter comprises a driver for supplying power to and controlling the spotlight.

12. Spotlight according to claim 11, wherein a guide bar (182) is fixed to the container (140) and inserted inside a vertical-axis hole (134*a*) of an upright (134) integral with the movable frame, so as to form a guide element for the vertical displacement of the frame (130).

13. Spotlight according to claim 1, characterized in that the movable frame comprises a vertical flange (135) with a transverse-axis hollow sleeve (135*a*), and a motor (171) which is arranged on the frame (130) and is displaceably integral therewith wherein the axis (171*a*) of the motor extends parallel to the transverse direction (Y-Y) and is inserted inside the sleeve (135*a*) so as to project transversely outside of the frame (130); a pinion (172) being fixed to the axis (171*a*) of the motor and meshing with the teeth (181) of a rack (180) extending parallel to the vertical direction (Z-Z) and fixed to the inner surface of the container (140).

14. Spotlight according to claim 1, wherein the movable frame is in the form of an annular ferrule (130) or a plate.

15. Spotlight according to claim 1, characterized in that it comprises a sliding friction means (125) coaxially inserted inside the gear wheel (121) and/or between the means for rotationally actuating the support arm about the vertical axis and the movable frame or the support arm itself and/or between the means for displaceably actuating the movable frame and the container.

* * * * *